US009899158B2

(12) United States Patent
Zacharias et al.

(10) Patent No.: US 9,899,158 B2
(45) Date of Patent: Feb. 20, 2018

(54) COOLING DEVICE FOR GASES OCCURRING IN INSTALLATION EQUIPMENT

(71) Applicant: EATON ELECTRICAL IP GMBH & CO. KG, Schoenefeld (DE)

(72) Inventors: Albert Zacharias, Neuwied (DE); Christian Ruempler, Wexford, PA (US)

(73) Assignee: EATON UNIVERSITY IP GMBH & CO. KG, Schoenefeld (DE)

( * ) Notice: Subject to any disclaimer, the term of this patent is extended or adjusted under 35 U.S.C. 154(b) by 91 days.

(21) Appl. No.: 14/438,884

(22) PCT Filed: Oct. 31, 2013

(86) PCT No.: PCT/EP2013/072802
§ 371 (c)(1),
(2) Date: Jun. 17, 2015

(87) PCT Pub. No.: WO2014/068052
PCT Pub. Date: May 8, 2014

(65) Prior Publication Data

US 2015/0279586 A1 Oct. 1, 2015

(30) Foreign Application Priority Data

Oct. 31, 2012 (DE) ..... 10 2012 110 409

(51) Int. Cl.

| | |
|---|---|
| ***F28F 7/00*** | (2006.01) |
| ***H01H 9/34*** | (2006.01) |
| ***H01H 9/52*** | (2006.01) |
| ***H01H 71/02*** | (2006.01) |

(52) U.S. Cl.
CPC ..... *H01H 9/342* (2013.01); *H01H 9/52* (2013.01); *H01H 71/0228* (2013.01)

(58) Field of Classification Search
CPC ..... H01H 71/0028; H01H 9/52; H01H 9/342
USPC ..... 165/80.3; 218/149, 150, 151, 157, 158
See application file for complete search history.

(56) References Cited

U.S. PATENT DOCUMENTS 2,272,214 A * 2/1942 Linde ..... H01H 33/08 218/81
2,861,152 A 11/1958 Scully
3,286,065 A * 11/1966 Stringfellow ..... H01H 9/34 218/149

(Continued)

FOREIGN PATENT DOCUMENTS

DE 1299346 B 7/1969
DE 1640265 A1 8/1970

(Continued)

*Primary Examiner* — Claire Rojohn, III
(74) *Attorney, Agent, or Firm* — Leydig, Voit & Mayer, Ltd.

(57) ABSTRACT

A cooling device for hot gases occurring during and after a switching process in electrical installation equipment, preferably in low-voltage circuit breakers, includes a window, with narrow passage openings, arranged in the flow path of the hot switching gases, wherein the window is made from a material with high thermal conductivity and high heat capacity. The passage openings in the window are planar in shape and are arranged parallel to the flow direction of the switching gases such that no deflection of the switching gases takes place.

14 Claims, 2 Drawing Sheets

(56) References Cited

U.S. PATENT DOCUMENTS 3,448,231 A * 6/1969 Heft ..... H01H 9/342 218/149
3,516,090 A * 6/1970 Hurtle ..... H01H 71/504 335/16
3,555,224 A * 1/1971 Frind ..... H01H 9/342 218/149
3,603,755 A * 9/1971 Ranzanigo ..... H01H 5/06 200/244
3,859,487 A * 1/1975 Berberich ..... H01H 9/346 218/149
4,019,006 A * 4/1977 Strossner ..... H01H 73/18 218/156
4,362,915 A 12/1982 Swindler
5,136,451 A * 8/1992 Valdemarsson ..... H01H 9/302 218/143
5,889,249 A 3/1999 Rival et al.
6,480,080 B1 * 11/2002 Asada ..... H01H 1/2058 200/244
7,488,915 B2 * 2/2009 Pollitt ..... H01H 9/342 218/149
2006/0086693 A1 * 4/2006 Yeon ..... H01H 9/302 218/149
2006/0213873 A1 * 9/2006 Shea ..... H01H 9/342 218/34
2008/0277382 A1 * 11/2008 Chen ..... H01H 9/36 218/151
2009/0314746 A1 12/2009 Bahlinger et al.
2011/0290761 A1 * 12/2011 Haeberlin ..... H01H 9/345 218/151
2012/0120558 A1 * 5/2012 Raabe ..... H01H 9/342 361/619
2013/0140275 A1 * 6/2013 Shea ..... H01H 9/342 218/149
2013/0264311 A1 * 10/2013 Lang ..... H01H 1/2025 218/2
2014/0346146 A1 * 11/2014 Kharade ..... H01H 9/36 218/151
2015/0136740 A1 * 5/2015 Afshari ..... H01H 33/08 218/149

FOREIGN PATENT DOCUMENTS

DE 1640153 B1 5/1973
DE 3541514 A1 5/1987
DE 102008021025 A1 10/2008
DE 102010034264 B3 2/2012
EP 0817223 A1 1/1998
EP 1463075 A2 9/2004
GB 1140612 A 1/1969
WO WO 2008110236 A1 9/2008

* cited by examiner

COOLING DEVICE FOR GASES OCCURRING IN INSTALLATION EQUIPMENT

CROSS-REFERENCE TO RELATED APPLICATIONS

This application is a U.S. national stage application under 35 U.S.C. §371 of International Application No. PCT/EP2013/072802, filed on Oct. 31, 2013, and claims benefit to German Patent Application No. DE 10 2012 110 409.3, filed on Oct. 31, 2012. The International Application was published in German on May 8, 2014, as WO 2014/068052 A1 under PCT Article 21(2).

FIELD

The invention relates to a cooling device for hot gases occurring during and after a switching process in electrical installation equipment, preferably in low-voltage circuit breakers.

BACKGROUND

When electric currents are switched off in electromechanical switching devices, a switching arc occurs when the contacts are opened. The arc heats up the air in the switching chamber, which leads to an increase in pressure and consequently to an emission of the heated gases through discharge openings—hereinafter referred to as discharge. These heated and conductive gases also contain solid particles in dispersed form, and depending on their composition and gas temperature are conductive to different extents, even after leaving the installation equipment. The processes during discharge (temperature and chamber pressure) must be taken into consideration in the design of switching chambers (rigidity of the housing).

A large part of the arc energy is already absorbed inside the switching chamber by the chamber walls. In order to cool and split the switching arc, extinction plates which bring about the rapid extinction of the arc are normally used in circuit breakers. This arc cooling process inside the switching chamber occurs at a high temperature level and takes place primarily through radiative transfer.

The hot discharged gases are electrically conductive and can generate arcs outside of the installation equipment between live parts and cause damage unless sufficient clearance from adjacent, conductive and potentially live parts is maintained.

A cooling device in low-voltage circuit breakers is known, where a fine mesh metallic grille or grate is used (EP 0817223 B1).

Other inventions are also concerned with the cooling of the discharge; for example in U.S. Pat. No. 7,488,915 B2 or in DE 102010034264 B3. In these solutions, however, the flow is deflected multiple times. Disadvantages of these arrangements are that a build-up of pressure resulting from the flow deflection occurs along the cooling device and has an adverse effect on the switching characteristics. If one wishes to avoid this effect, an enlargement of the cross section must be undertaken. As a result of the complex flow control (including many deflections) and the delicate structure, blockages of the flow passages caused by particles in the discharge and damage to the mesh can occur in the case of fine gauge cooling meshes (EP 0817223 A1).

DE 1640265 A1 describes a cascade of cooling devices, where plates at the exit of a precooler are angled, the intention being to make it more difficult for arcs to return. Furthermore, DE 35 41 514 A1 describes an arc extinguishing chamber with an attachment for further cooling of the escaping gases.

SUMMARY

An aspect of the invention provides a cooling device for switching gases occurring after a switching process in electrical installation equipment. The device includes: a window including a narrow through-opening arranged in a flow path of the switching gases, wherein the window includes a metallic material with high thermal conductivity, high heat capacity, or both. The through-opening in the window is formed from planar cooling plates orientated in parallel with the flow direction of the switching gases.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
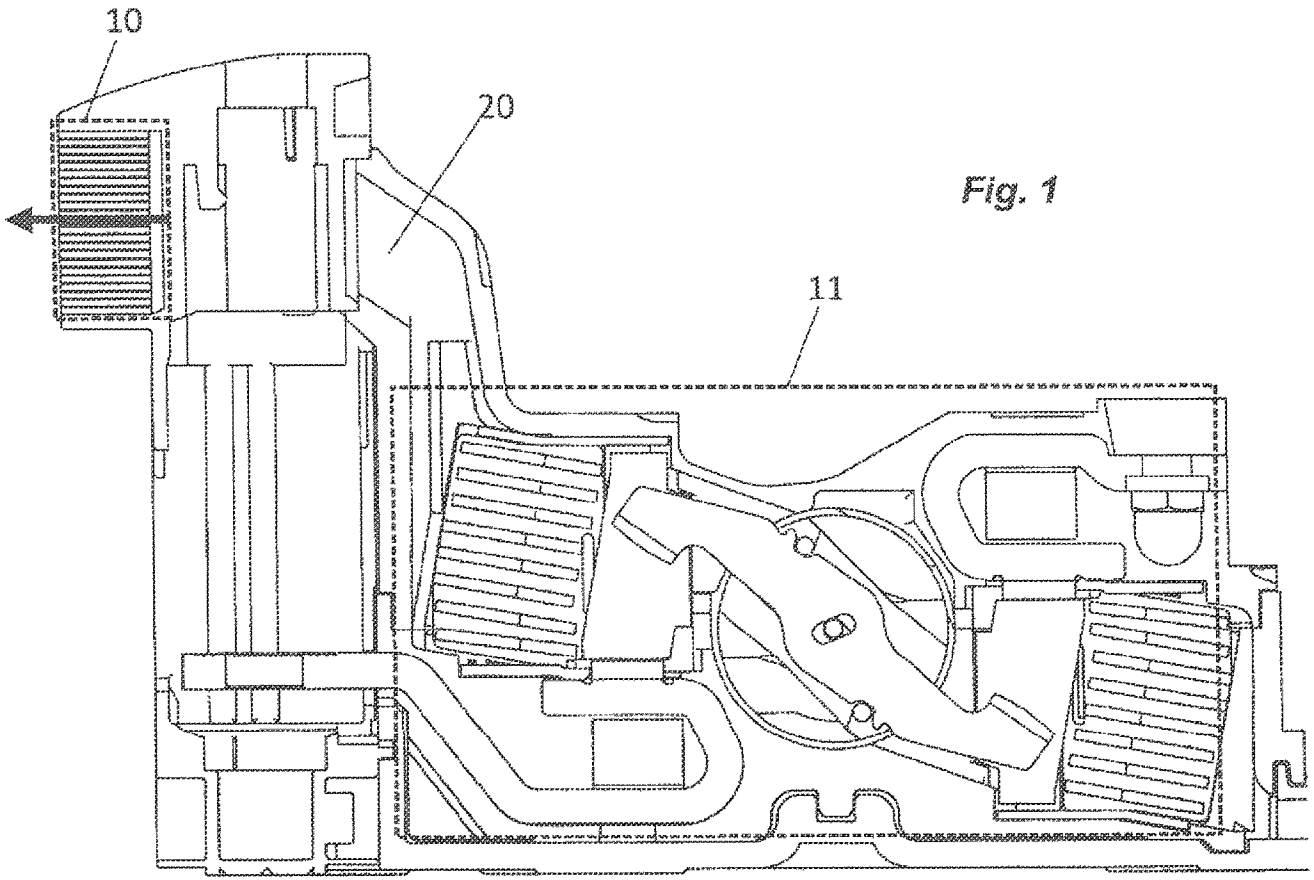
FIG. 1: shows a cooling device in the switching gas flow of a switching device.

An aspect of the invention is to provide a device on installation equipment which acts to cool discharged switching gases and where only a minimal build-up of pressure takes place in the switching chamber.

An aspect of the invention is that, in the flow path of the gases, the switching gases flow with as little manipulation as possible through a window having narrow through-openings, and that the window is made from a material with high thermal conductivity and high heat capacity determined by volume and mass. The through-openings in the window are planar in shape and are arranged in parallel with one another. The through-openings establish the flow path and flow direction of the switching gases. The temperature of the switching gases is lowered by the cooling device to the extent that they lose their electrical conductivity and thus a substantial part of their harmful effect. There is little effect on the switching characteristics. As a result of the cooling device neither the flow nor the build-up of pressure inside the switching chamber is affected much.

The discharge is conducted between parallel flat cooling plates, for example made from materials (metal) with very narrow spacing (vents). The cooling plate spacing is considerably narrower than typical arc extinguishing plate spacing. The narrow spacing ensures good convective heat transfer out of the gas into the surface of the cooling device. Due to the high thermal conductivity, the heat is quickly conducted away from the surface. A fusing of the material is prevented. In the process, the heat is temporarily stored in the plates themselves, which is achieved by an appropriate heat capacity of the plates. Due to the planar plates, which are arranged in parallel with the flow, no deflection of the flow occurs; the build-up of pressure is reduced to a minimum. The geometrically simple structure makes the arrangement according to the invention less sensitive to damage and blockages by the discharge.

Metallic cooling plates of the cooling device can (but do not have to) be conductively connected to one another. The cooling device should be arranged in the flow path behind an arc extinguishing device. The cooling device should be arranged at the end of the switching chamber such that an arc escaping beyond the arc extinguishing device does not reach the cooling device. Such an arc must not be allowed to find contact or an end point on the cooling device. The cooling plates are relatively thin and are not suitable for an arc extinguishing device.

Narrow vents between the cooling plates ensure good heat transfer between gas and cooling plates. Vents of approximately 0.1 to 0.5 mm wide are advantageous. The dimensions of the window, meaning the number of vents and width and breadth of the vents, are adapted to the discharge characteristics of the specific equipment. The given total cross section is determined by the number of vents, by the vent width and the vent breadth. The dimensions of the cooling device are substantially determined by the switching characteristics of the installation equipment, with the parameters of switching capacity and nominal current.

Preferred embodiments are listed briefly below

- The through-openings are formed by planar cooling plates; the cooling plates form a compact stack as a self-supporting structure.
- The entire switching gas flow passes through the through-openings. There should be no lateral openings; potentially to be closed by appropriate sealing.
- All cooling plates have the same thickness, preferably a thickness of 500 to 1000 μm can be provided, the thickness having smaller values in the case of a high thermal absorption capacity of the cooling plates and adopting larger values in the case of a lower thermal absorption capacity of the cooling places.
- All through-openings should be formed from planar cooling plates; all through-openings can have the same expansion.
- The through-openings have a width transversely to the flow direction of 100 to 500 μm.
- The cooling device can be arranged detachably on the housing of a piece of installation equipment or incorporated into the installation equipment.

When selecting the material for the cooling device, a material with good thermal conductivity coupled with high heat capacity and an adequately high melting temperature is selected. These properties are fulfilled according to the invention by various steels, for example, (preferably simple structural steel) and copper alloys. Ceramics with good thermal conductivity can, however, also be used in principle. The cooling plate thickness and the material of the cooling plates are selected such that the heat of the discharge is absorbed without melting.

The cooling plates can preferably be constructed as a compact stack; this means that the cooling plates are mechanically connected to one another. Precise adherence to the narrow spacing is ensured using appropriate elements, which are arranged at the sides or in between the cooling plates. In this compact form the stack can be inserted into the window constructed in the switching flow path or in a frame constructed there. The entire switching gas flow should pass through the stack. The stack is sealed to prevent lateral openings.

The metallic plates of the cooling device can be connected in an electrically conductive manner. As mentioned above, an obstacle in the discharge duct creates an increase in pressure, which affects the switching characteristics of the installation equipment. In particular, deflections of the flow constitute such an obstacle. The present arrangement should manage with the slightest increase in pressure. Pieces of installation equipment are each designed such that the switching chamber remains intact with respect to present increases in pressure which are dependent on the maximum switching capacity.

According to an aspect of the invention, deflections in the gas flow are prevented such that an increase in pressure is reduced to a minimum. This makes it possible (depending on customer requirements) to also install the cooling device optionally outside of the equipment (the switching chamber) in front of the discharge opening without causing relevant effects on the switching characteristics.

By preventing deflections in the gas flow, blockages in the arrangement caused by deposits are also reduced in contrast, for example, to fine mesh metal grilles. Even a partial blockage can lead to an increased build-up of pressure.

The arrangement according to the invention can be used in principle in all electromechanical switching devices which produce a considerable discharge. This can occur advantageously in the case of circuit breakers, line circuit breakers and motor circuit breakers.

- The cooling process takes place with simultaneously lower pressure drops.
- The cooling device can optionally be added onto the installation equipment (for example as an accessory). The cooling device can also be introduced into a frame, which can then be added onto a piece of installation equipment.
- A safety clearance with respect to further conductive parts located near the installation equipment can be reduced since the escaping switching gases are deionised and cooled to the extent that they are no longer conductive.
- Reduced outlay for shielding when using the switching devices in confined housings, switchgear cabinets, etc.

FIG. 1 shows a cooling device 10 by way of example, which is incorporated into the terminal cover (or in the discharge duct) of a piece of installation equipment shown as a circuit breaker. A window 13 having narrow through-openings 17, 18 and made from a material with high thermal conductivity and high heat capacity is arranged in the flow path 20 or in the discharge opening of the hot switching gases. The switching gas flow 20 from the switching chamber 11 flows through the cooling device. Burning arcs should not be able to reach the cooling device. The mounting inside the installation equipment can be such that the cooling device forms an integral component of the device, or the cooling device can be detachably mounted on the housing of the installation equipment. Appropriate fixing means are not shown, but can, for example, consist of screw connections.

Figure 2:
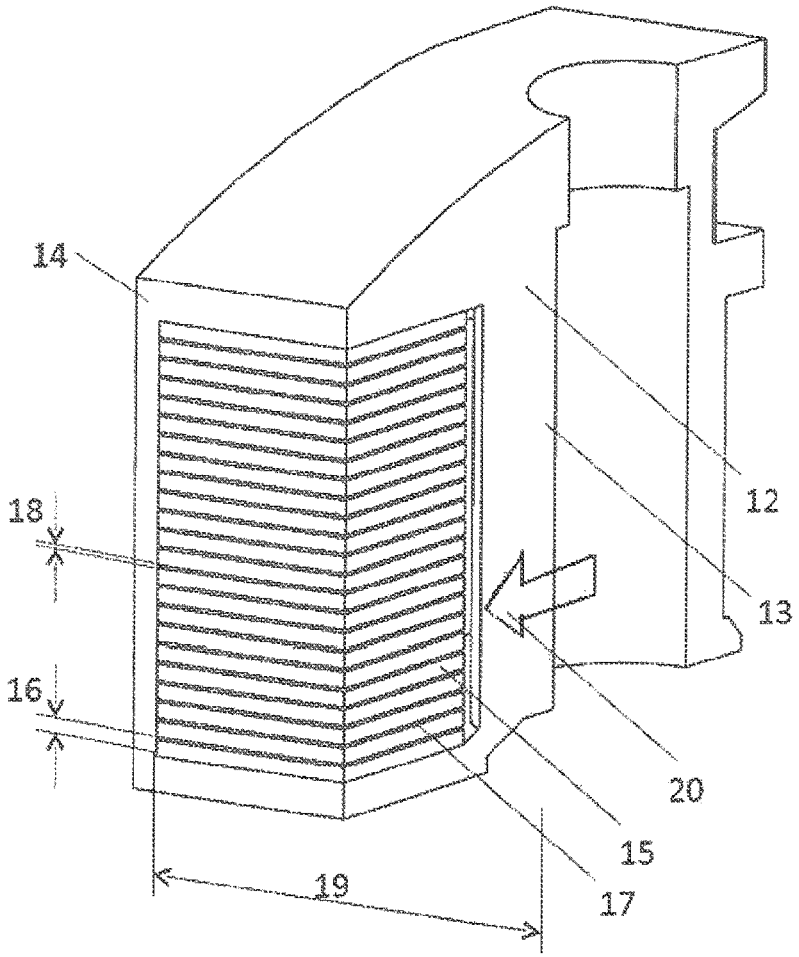
FIG. 2: shows a cooling device in detail (sectional view).

FIG. 2 is a sectional view, the section running perpendicularly through the centre of the cooling device 10 (with reference numeral 12 as the sectional plane). Between the through-openings 17, cooling plates 15 are arranged transversely to the flow direction 20 and form the stack of cooling plates. The position of the cooling plates 15 can be horizontal (as in the drawing) or vertical. In the embodiment shown in the drawing according to FIG. 2, there are twenty-three cooling plates which together with the frame 14 constitute the heat capacity of the cooling device depending on their dimensions, volume and material. Twenty-two vents 17 are formed in between the cooling plates.

All of the cooling plates 15 have the same thickness 16. The thickness 16 should preferably have a value of between 500 to 1000 μm. For certain application cases the thickness can also be selected from a narrower range of between 700 to 900 μm.

All of the through-openings, which are formed as flat, planar vents 17, have the same expansion with respect to width 18 and breadth 19. The vent width 18 transverse to the flow direction 20 and transverse to the orientation of the cooling plates can be graduated in each case between: 100 to 500 μm, or 250 to 400 μm, or even narrower 200 to 300 μm depending on the gas mass flow to be expected. The total cross section of the through-openings is substantially determined by and dependent on the switching capacity and nominal current of the installation equipment. The total cross section of the through-openings of the embodiment shown in the drawing in FIG. 2 has a size of approximately 300 $mm^2$, when a width=0.2 mm, and breadth=20 mm and the quantity of 22 are taken as the basis.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

10 Cooling device
11 Switching chamber
12 Sectional plane
13 Window
14 Frame
15 Cooling plate
16 Plate thickness
17 Vent
18 Vent width
19 Vent breadth
20 Switching gas flow

The invention claimed is:

1. A cooling device for switching gases occurring after a switching process in electrical installation equipment, the switching gases having a flow direction, the device comprising:

a window including a plurality of planar cooling plates oriented in parallel with the flow direction of the switching gases, with a narrow through-opening between each pair of adjacent cooling plates, the through-openings being arranged in a flow path of the switching gases, wherein each of the plurality of cooling plates comprises a metallic material with high thermal conductivity, high heat capacity, or both, wherein each of the through-openings has a width of 100 to 500 μm transverse to the flow direction, and wherein the plurality of cooling plates are connected to one another in an electrically conductive manner.

2. The device of claim 1, wherein the cooling plates form a compact stack with a self-supporting structure.

3. The device of claim 1, wherein the cooling plates comprise a steel alloy.

4. The device of claim 1, wherein all of the cooling plates have the same thickness.

5. The device of claim 4, wherein the cooling plates have a thickness of 500 to 1000 μm.

6. The device of claim 1, wherein all of the through-openings have an expansion with respect to width and breadth that is the same.

7. The device of claim 1, configured to be detachably arranged on a housing of a piece of installation equipment.

8. The device of claim 1, integrated in a housing of a piece of installation equipment.

9. The device of claim 1, arranged in the flow path behind an arc extinguishing device.

10. The device of claim 1, wherein the cooling plates comprise steel.

11. The device of claim 1, wherein the cooling plates comprise copper.

12. The device of claim 1, wherein the cooling plates comprise a copper alloy.

13. The device of claim 1, wherein the cooling plates have a thickness of 500 to 1000 μm.

14. A low-voltage circuit breaker, comprising the device of claim 1.

* * * * *